US005490687A

United States Patent [19]

Scholl

[11] Patent Number: 5,490,687

[45] Date of Patent: Feb. 13, 1996

[54] WHEELCHAIR, IN PARTICULAR FOR PARAPLEGICS

[76] Inventor: Rainer Scholl, Eachenatr 6, 75223 Niefern-Oschelbronn, Germany

[21] Appl. No.: 150,118

[22] PCT Filed: May 6, 1992

[86] PCT No.: PCT/DE92/00355

§ 371 Date: Mar. 7, 1994

§ 102(e) Date: Mar. 7, 1994

[87] PCT Pub. No.: WO92/19202

PCT Pub. Date: Nov. 12, 1992

[30] Foreign Application Priority Data

May 6, 1991 [DE] Germany ..... 9105574 U
Dec. 13, 1991 [DE] Germany ..... 41 41 158.7

[51] Int. Cl.[6] ..... A61G 5/00; A61G 5/14

[52] U.S. Cl. ..... 280/250.1; 5/81.1; 280/304.1; 297/DIG. 10

[58] Field of Search ..... 280/250.1, 304.1; 297/DIG. 4, DIG. 10; 5/81.1

[56] References Cited

U.S. PATENT DOCUMENTS 3,023,048 2/1962 Barton ..... 297/DIG. 10
4,948,156 8/1990 Fortner ..... 280/304.1

FOREIGN PATENT DOCUMENTS 2259383 6/1974 Germany .
78000828 2/1980 Sweden ..... 5/81.1
531184 12/1940 United Kingdom .
1407033 9/1975 United Kingdom ..... 297/DIG. 10
2178375 2/1987 United Kingdom .

*Primary Examiner*—Mitchell J. Hill
*Attorney, Agent, or Firm*—Loeb and Loeb

[57] ABSTRACT

A wheelchair composed of a frame with a seating surface, a backrest, a plurality of wheels and a lifting device for lifting a user of the wheelchair from a seated position to a standing position. The lifting device includes two spars connected to the frame to have a substantially vertical orientation when in use and a mechanism for converting a manual force into a lifting force for lifting the user toward the standing position. The mechanism for converting is composed of: a seating band positionable to act on the user's body; at lease two deflection rollers on each spar; and at least one lifting cable linked to the seating band and passing around the deflection rollers in order to guide the seating band in a manner to cause the lifting force to be directed forwardly and upwardly. The lifting device is operative for placing the user in the standing position and for supporting the upper part of the user's body when he user is in the standing position, and the lifting device additionally includes a securing member for securing the mechanism for converting in place when the user has been placed in the standing position by the lifting device.

11 Claims, 3 Drawing Sheets

WHEELCHAIR, IN PARTICULAR FOR PARAPLEGICS

TECHNICAL FIELD

The invention relates a wheelchair, in particular for paraplegics, and has a frame with a seating area, a backrest and a number of wheels, with a lifting device with two spars almost vertically arranged during use, linked to the wheelchair, and provided with means for converting a manual force that lifts the user into a lifting force that acts upon the body of the user by means of holding means and at least one lifting cable linked thereto, whereas the device may be secured in the standing up position of the user.

DESCRIPTION OF THE PRIOR ART

From the DE-OS 22 59 383 it is known, that to make the standing up easier for a wheelchair user slanted mounted guide sleeves are used to locate practically horizontally guided bent spars. At the ends of the spars are mounted tension levers which tension the rubber bands. These rubber bands grip onto the seating band on the user's backside so that when the tension lever is operated the user can stand up. The prevent the knees from moving a knee belt is used. The user is thereby precisely held in the hip-joint area from behind, he must however support himself at the front by holding onto one of the spar with one hand. The user can not thereby be fully supported in the standing up position, so instead he only has one hand free to carry-out any extra work.

From the U.S. Pat. No. 4,530,122 it is known, that to relieve the pressure on the user's backside it must be raised from its seating position. To achieve this, the wheelchair is mounted with a spar to which, on its upper rear side, an eccentric disc is secured. On one side of the disc is mounted a lever and on the other side a cable, and attached to the user by means of a vest. On pulling the lever towards him the user raises his body. In this position the lever can be secured to the wheelchair.

Wheelchair users sometimes do not have enough strength to lift themselves up. A limited standing up period is both, for medical reasons eg. to improve blood circulation, and also for practical reasons eg. to be able to reach high shelves or presses, necessary and is the reason why different stand-up wheelchairs are suggested. These stand-up chairs have a special mechanism whereby the seat area and the backrest can be turned up into a vertical position so as to support the user in the upright position (EP 0159 562 B1, prospectus from LEVO AG, Bleicheweg 5, CH-5605 Dottikon, "Die Stehhilfe im Rollstuhl" ("The standing up aid in a wheelchair")). These wheelchairs are however relatively heavy and unprepossessing. There is here no comparison to the modern light sport wheelchairs and in particular to their ease of handling eg. when loading into a vehicle. A similar mechanism can be seen on the stationary chair referred to in GB-PS 531,184.

Furthermore it is also known, that the standard "standing up equipment" or "free-standing bars" have no provision for securing a wheelchair to them. These types of equipment are heavy and unwieldy and are practically impossible to move without help plus they are generally cumbersome and are usually not located where they are most needed at the time (DE-DM 81 35 539).

SUMMARY OF THE INVENTION

It is an object of the invention to design a standing up device which can be used in conjunction with any desired wheelchair and by using simple means, thereby allowing an almost normal standing up movement to be achieved.

This task can be achieved by using the standing up device as a lifting means of the user into a vertical position, and which uses as converting means on each spar at least two deflection rollers, which convert the standing up force, through a seating band acting as a holding means, into a forwardly and upwardly directed force.

With such a system the user can stand up, providing he has enough use and strength in his arms, when and where he wants to without the help of any other person. Standing up is thereby made easier by the fact that the natural standing up movement is obtained through the force exerted on the seat-pad so that the user does not have to adopt a new standing up method. A fully secured upright position can thereby be obtained. In the standing up position the user's backside is supported by means of the seat-pad and the upper body by means of the spars.

The fact that the wheelchair's removable spars can be swivelled through a pivot point, and are securable in a vertical position, and that the pivot point is arranged between a level determined by the spars in their function position and the rear wheels, preferably below a level determined by the seating area, whereby the spars, in their function position, are secured by means of quick-release or notch device, and in their rest position by means of quick-release device near the pivot point and in a holding device, and when moved into their function position are automatically guided into the guide sleeves, means that generally the removable spars, when out of use, can be swung into a rest position, so it is not necessary to change the spars each time from location to location. However it does not matter whether the guide sleeve is mounted to the spar or fixed to the wheelchair.

Preferably the pivot point is so situated, for such a swing movement, that the spars are automatically guided, however it does not matter whether the guide sleeve is mounted to the spar or fixed to the wheelchair. The device is thereby easy to assembly and disassemble by means of a few hand movements.

The preferred standing up device design has front floor supports which project forward during use, whereby they are hinge connected to the spars and while moving the spars into their function position the floor supports are automatically brought into their function position or the spars themselves can carry out this function. Thereby a safer and better standing up function is achieved, in particular with regard to changes in the centre of gravity, whereby, as required, an automatic relocation into the seating position is possible.

With an alternative design the spars can be telescopically pushed together when not required and stored in their final or intermediate position. Thereby it is possible, for transporting or when not in use, to store the standing up device, for example, in a bag on the wheelchair. It is thereby possible for the user to convert his wheelchair, at any time, into a standing up device. If the spars are located in their swivelled position, the rest of the unrequired parts can be stored in a bag on the wheelchair.

With an additional modification the user's knees can be supported and prevented from moving by means of a knee holder, whereby a knee holder is preferred with either a material band or a padded area, with cut-outs to relieve the kneecaps, and padded between the knees and positioned and secured around the spars. Without this additional safety measure three is a danger that the knees would bend forward during standing up as a result of the movement of the body, or while standing would buckle, which can be prevented by the right positioning of the knee holder. The cut-outs prevent pressure points on the skin of the knee-caps.

With an additional design the user's feet can be supported by means of a foot plate with a holding band, whereby the adjustable foot plate is fixed to the foot piece of the wheelchair at the front by means of a hook or suitable foot pad and at the back by means of a holding band hooked onto the frame of the wheelchair.

BRIEF DESCRIPTION OF THE DRAWINGS

As seen.

DETAILED DESCRIPTION OF THE PREFERRED DESIGN FORM

Figure 1:
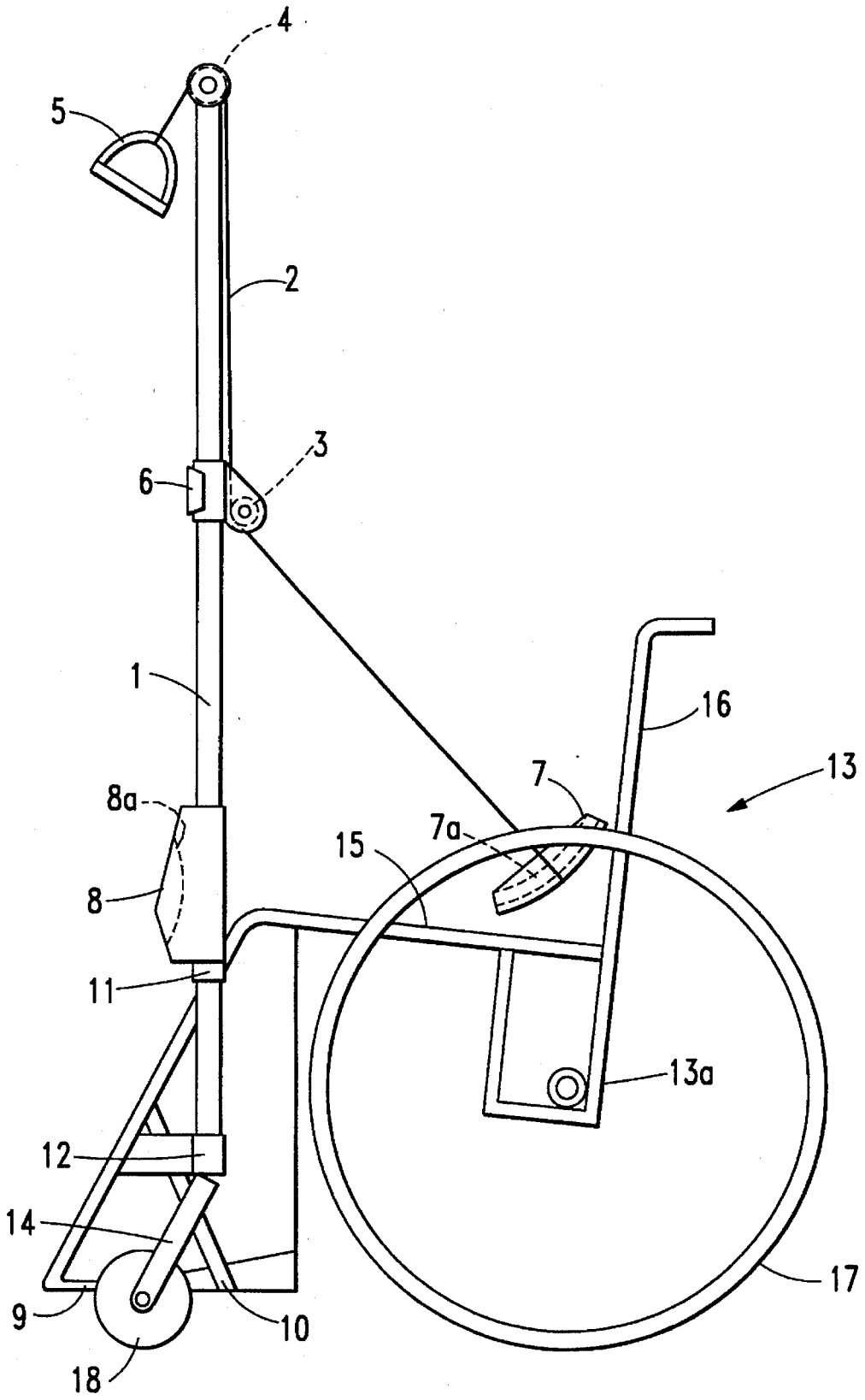
FIG. 1 The wheelchair in side view with its mounted standing up device.
Figure 2:
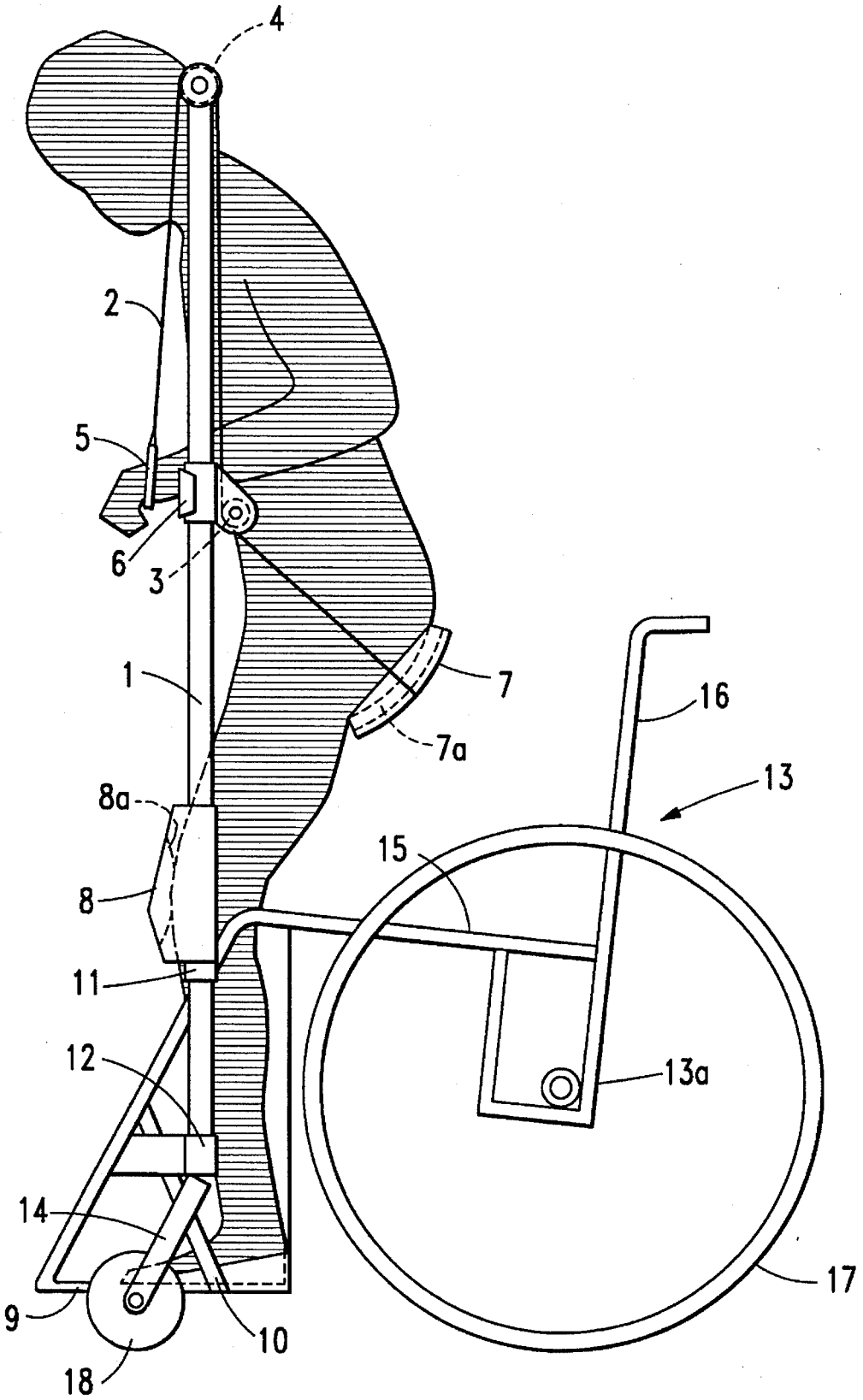
FIG. 2 The wheelchair according to FIG. 1, but with the user in the motion of standing up ie. pulling up.

On wheelchair 13 (FIG. 1) which consists of a frame 13*a* with seat area 15 and back rest 16, with two large wheels 17 and two small wheels 18 for movement which are mounted to the frame 13*a*, there are means for securing two side-mounted spars 1 vertically arranged during use. These means, with respect to the design example according to FIGS. 1 and 2, are an upper guide sleeve 11 and a lower guide sleeve 12. Naturally, instead of these, a fixing device or something similar can be used to secure the spars. The spars 1 can be at any time easily inserted or secured by means of only a few hand movements from the user, so that he has the possibility, when and where he wishes, to convert his wheelchair into a standing up device.

Spars 1 are part of a lifting device used as a standing up device, which brings the centre of gravity of the user beyond the centre of gravity of the wheelchair 13 or at least leads to a relative movement bringing the centers of gravity closer together. As means for converting a manual or mechanical force that lifts the user into a lifting force that acts upon the body of the user, by means of the seating band 7 used as a holding means, and at least one lifting cable 2 linked thereto, on each of the inserted spars 1 at least two deflection rollers 3, 4 are foreseen. One of the deflection rollers is so arranged that it converts the lifting force which acts on the body of the user into a resulting forward and upwardly direct force, which supports the standing up movement. This deflection is important because only so can the standing up be supported.

In the above-mentioned example the seating band 7 is located under the backside of the user. The lifting cable either has a hand grip 5 or is driven by means of an electric motor. The hand grips 5 are fixed to one end of the lifting cable, whereas, at the opposite end of the cable 2 or, at the end of both halves of cable 2, is fixed the seating band 7. Two lifting cables could of course be used. The user can achieve this standing up movement and position by means of pulling the hand grips attached to the lifting cable. When in the standing up position the lifting cable 2 or an alternative band can be secured to the spars in at least one respective fixing device. The fixing device is used in the form of clamp 6. As a clamping means eg. a cable, sheet, or a sandwich clamp could be used and of course instead of these clamps hooks and rings could be used. After the cable is secured the user, in the standing up position, can use his hands freely.

Figure 3:
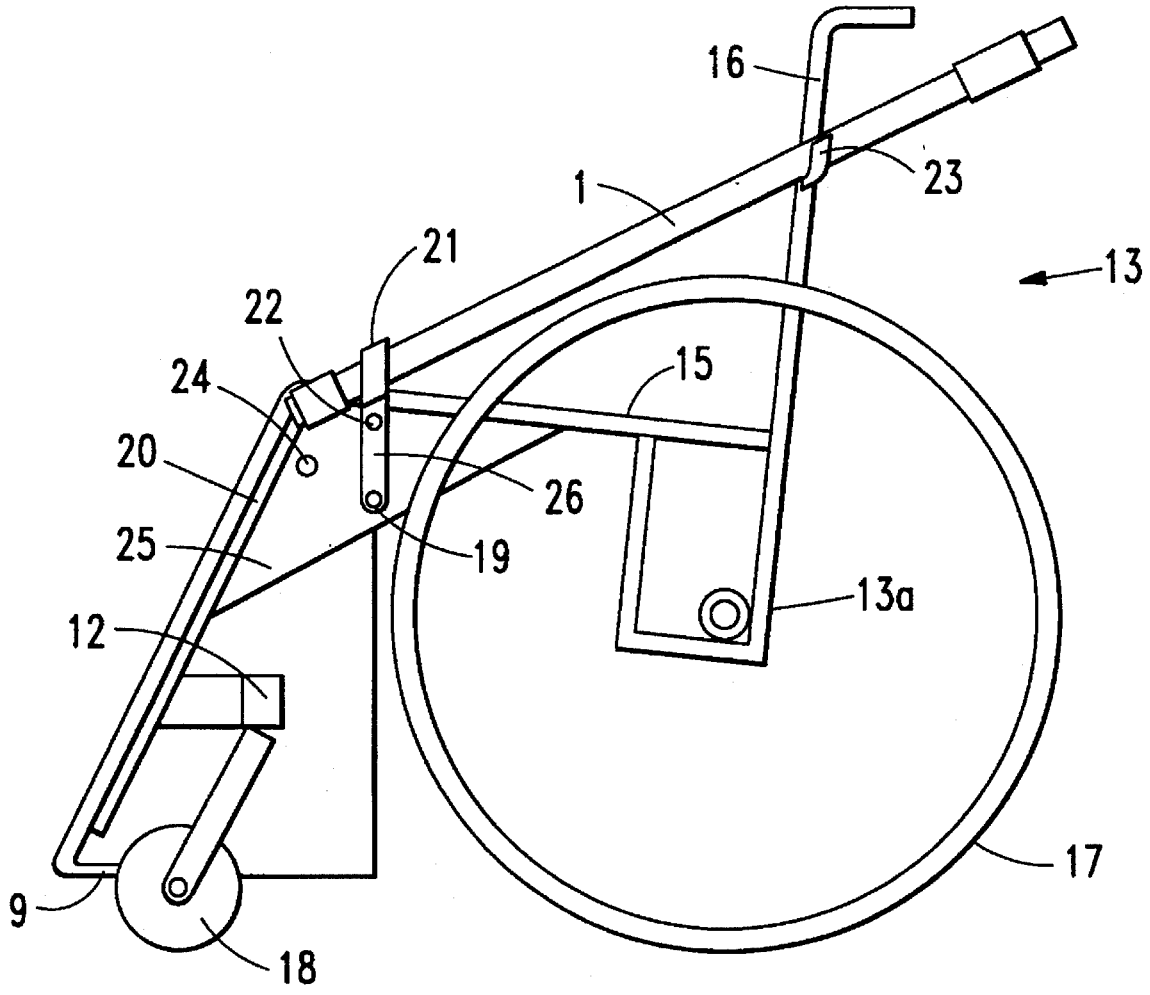
FIG. 3 The wheelchair with an extended design form with hinged spars which can be swivelled.

In the example shown in FIGS. 1 and 2 the spars are inserted into the guide sleeves, whereas in the example shown in FIG. 3 the removable spars can be swung through the pivot point 19 located on the wheelchair which means the spars do not have to be removed when moving from one location to the other. The pivot point 19 is located on the angle plate 25 which is mounted underneath the set of the wheelchair. The pivot point is thereby located in such a position so that there is a forward movement stop when the spars are in their vertical position and an upward stop when they are swung up against the seat. The spar is connected to the pivot point by means of the connecting piece 26.

As a result of the distance between the pivot point and the spar it is possible for the spar, when being brought from the rest position into its function position, to automatically locate itself ie. to insert itself into the lower guide sleeve 12.

In the rest position the spar 1 is located on a holding bracket near the backrest and can be secured by means of a quick-release device to prevent it from coming loose when not required. The quick-release device can either be located near the holding bracket 23 or, for example, a locking lever or a ball fastener located near the pivot point 19. After locating the spar in the function position a quick-release device attached to the connecting piece 26 engages with its mating piece attached to the angle plate 25, so that the spar is also locked in this position. This locking means can easily be released eg. by means of a push button.

Generally both model types can be used with floor supports which are shown on the second example type as position '20'. The function of the floor supports are to give extra forward support to the standing up device. Where the floor supports are connected to the spars, and in particular where the spars 1 are located in their swing rest position, and are then brought into their function position the floor supports are automatically moved into their correct function position. To achieve this the floor support 20 and spars are connected at the front end of the pushed together spar and furthermore the floor supports 20 are guided near to the guide sleeves. It is also possible to construct the spar 1 so that it could also act as a floor support.

To prevent the device from interfering with the transportation of the wheelchair, and in particular when loading it into a vehicle or when moving it with a mounted standing up device, the spars can be telescopically pushed together. Furthermore, it is possible to arrange them, in their fully or partially pushed together length, into their end or intermediate position.

To make the standing up movement easier, a knee holder 8 can be used which prevents the user's knees from bending or buckling. The knee holder 8 is preferably made from, at least, a material band or a padded area 8*a*, with cut-outs for the kneecaps and padded between the knees to prevent damage to the skin on the kneecaps. The knee holder 8 is placed around the spars 1 and secured in the required position by means of a sticky band, a clamping late or a plastic clamp. It can also be secured directly to the wheelchair. As an additional safety measure a special foot piece 9 or a foot plate can be used, which can be permanently mounted to the wheelchair to secure the user's feet. The safety foot piece is adjustable and is secured to the front of the wheelchair's foot piece by means of a hook, a suitable pad or a sticky band. At the back it is attached by means of a support band 10 to the frame of the wheelchair. Thereby the support band 10 near the user's heel area is extended and provides support at the back and at the sides.

The seating band 7, which is connected to the hand grips 5 and the cable 2, consists of an anatomically formed shape of the user's backside, preferably a bulge shape, which provide a safe support for the user's backside in the seating band. This bulge shape can be obtained, for example, by means of vertically inserting strips 7*a* of metal, plastic or similar materials which can cope with the forces on the lifting cable 2. The seating band can be an anatomically formed plastic shape or a part or complete section of the seat and/or of the backrest padding to which the lifting cable is directly or indirectly connected.

I claim:

1. A wheelchair comprising a frame with a seating surface, a backrest, a plurality of wheels and a lifting device for lifting a user of the wheelchair from a seating position to a standing position, said lifting device comprising two spars connected to said frame to have a substantially vertical orientation when in use and means for converting a downward force into a lifting force for lifting the user toward the standing position, wherein said means for converting comprise: a seating band positionable to act on the user's body; first and second deflection rollers on each said spar, said first roller being mounted above said second roller; and two lifting cables linked to said seating band and each passing from said seating band, around said second roller on a respective one of said spars, then upwardly to and around said first deflection roller on the respective one of said spars in order to guide said seating band in a manner to cause the lifting force to be directed forwardly and upwardly, and further wherein:

said lifting device is operative for placing the user in the standing position and for supporting the upper part of the user's body when the user is in the standing position.

2. A wheelchair as defined in claim 1 wherein said lifting device further comprises means supporting said spars for a pivotal movement relative to said frame, and means for securing said spars in the substantially vertical orientation.

3. A wheelchair as defined in claim 2 wherein: said wheels include rear wheels; said spars are supported, by said means for supporting, to pivot about an axis which is located between the substantially vertical orientation of said spars and said rear wheels and below said seating surface; and said wheelchair further comprises means for securing said spars in an inclined orientation, and a holding bracket for holding each of said spars in the inclined orientation.

4. A wheelchair as defined in claim 1 wherein said spars comprise sections which can be telescoped together for storage.

5. A wheelchair as defined in claim 1 wherein said securing means comprise a holder mounted on each of said spars.

6. A wheelchair as defined in claim 1 wherein said lifting device further comprises a knee holder secured to each of aid spars, each said knee holder having a cut-out for receiving a kneecap of a user, and each said knee holder comprising padding for protecting a user's knee.

7. A wheelchair as defined in claim 1 further comprising a foot plate for supporting the user's feet and a safety band for securing the user's feet to the foot plate.

8. A wheelchair as defined in claim 7 wherein said foot plate is adjustable with respect to said frame and said wheelchair further comprises: a supporting band secured to said frame to provide a foot pad area; and side supports for the user's feet.

9. A wheelchair as defined in claim 1 wherein said seating band comprises a reinforcing member and an anatomically shaped section for supporting the user's back side.

10. A wheelchair as defined in claim 1 wherein said at least one lifting cable has a free end remote from said seating band; and said means for connecting further comprise a hand grip secured to said free end of said at least one lifting cable, said hand grip being grippable by the user for application thereto of the forward force.

11. A wheelchair as defined in claim 1 wherein said lifting device additionally comprises securing means for securing said converting means in place when the user has been placed in the standing position by said lifting device.

* * * * *